United States Patent [19]

Altmayer

[11] 4,279,068

[45] Jul. 21, 1981

[54] PORTABLE HYDRAULIC GEAR PULLING DEVICE

[75] Inventor: Joseph Altmayer, Kitchener, Canada

[73] Assignee: E & E Seegmiller Limited, Kitchener, Canada

[21] Appl. No.: 100,248

[22] Filed: Dec. 4, 1979

[51] Int. Cl.[3] ..... E21B 19/00

[52] U.S. Cl. ..... 29/252; 254/29 A; 254/93 R

[58] Field of Search ..... 29/252, 263, 293.52, 29/282; 254/29 A, 93 R

[56] References Cited

U.S. PATENT DOCUMENTS

| | | | |
|---|---|---|---|
| 2,775,869 | 1/1957 | Pointer | 254/106 X |
| 3,494,592 | 2/1970 | Meschonat et al. | 254/29 A |
| 3,785,617 | 1/1974 | Friedrich | 254/29 A X |

*Primary Examiner*—Robert C. Watson
*Attorney, Agent, or Firm*—Fetherstonhaugh & Co.

[57] ABSTRACT

A fluid gear or like pulling device comprising a body having a through axial bore adapted to admit a shaft; opposed piston chambers extending radially of the bore; pistons in the piston chambers and having a free end adapted to enter into the through bore; apparatus for pressurizing the piston chambers with fluid to force the piston outwardly of their chamber and into the through bore; a press ram mounted in the body for movement axially thereof; and apparatus for moving the press ram axially of the body, the body is sleeve shaped and the piston chamber extend through the sleeve shaped body from outside to inside, the outer end of the piston chambers being formed by the inner side of a ring that extends around the outside of the body.

2 Claims, 5 Drawing Figures

PORTABLE HYDRAULIC GEAR PULLING DEVICE

This invention relates to a portable hydraulic gear or like pulling device.

Portable devices of the general nature of this invention are not broadly new. It is common practice to provide a gear or like pulling device that can be locked against movement axially of a shaft and which, when so locked, is capable of exerting a pulling or pushing force with respect to a gear, pulley, sprocket bearing or the like for the purpose of either removing it from a shaft or pressing it onto a shaft. Portability in these devices is important because if one can remove a gear without removing the shaft upon which it is mounted from the piece of machinery in the field, considerable time and expense can be saved over and above a procedure where removal of the shaft from the machinery and transport of the shaft to a machine shop is necessary for the purpose of removing the gear.

With some portable devices of the prior art the pulling or pushing pressure has been hydraulically applied. This invention contemplates the use of hydraulic power for the pulling and/or pushing operation. There is nothing new in this use of hydraulic power and applicant acknowledges this particular aspect of the device to be old.

With the portable devices of the prior art, however, the device is mounted on the shaft against movement axially of the shaft by means of a threaded engagement with the shaft. There are many instances where it is not possible to achieve a threaded engagement of the device with the shaft because the shaft cannot be conveniently threaded or the shaft is not threaded. Even in those cases where threading is possible, the effectiveness of these devices is restricted because the location of the device axially of the shaft must be restricted to the location of the threading that has been applied for the purpose.

This invention overcomes the difficulties of the portable devices of the prior art in respect of the mounting of the device on the shaft. With this invention, it is possible to mount the device on most shafts in a range of locations that greatly increase the effectiveness of the device and that make it unnecessary in practically all cases to remove the shaft from the machine for the purpose of pulling a gear or applying a gear. In some cases, the use of the invention will save three days in downtime of a large machine where it has been previously necessary to remove the shaft from the machine and take it to a machine shop to remove a gear.

A hydraulic gear pulling device according to this invention comprises a fluid gear or like pulling device which comprises a body having a through axial bore adapted to admit a shaft, opposed piston chambers extending radially of said bore, pistons in said piston chambers and having a free end adapted to enter into said through bore, means for pressurizing said piston chambers with fluid to force said pistons outwardly of their chambers and into said through bore, a press ram mounted in said body for movement axially thereof and means for moving said press ram axially of said body.

The invention will be clearly understood after reference to the following detailed specification read in conjunction with the drawings.

Figure 1:
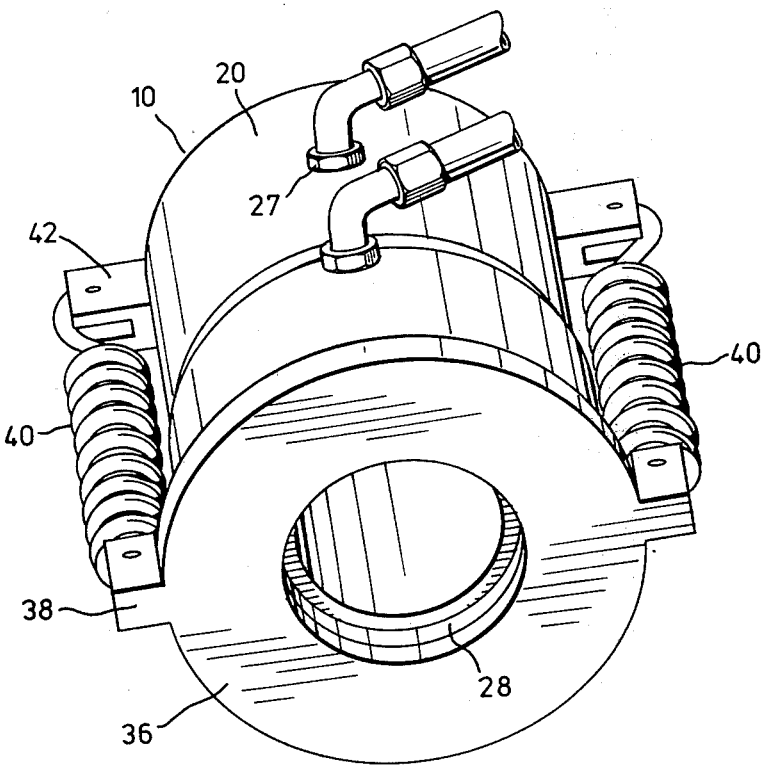
FIG. 1 is a perspective illustration of a hydraulic gear pulling device according to this invention.
Figure 2:
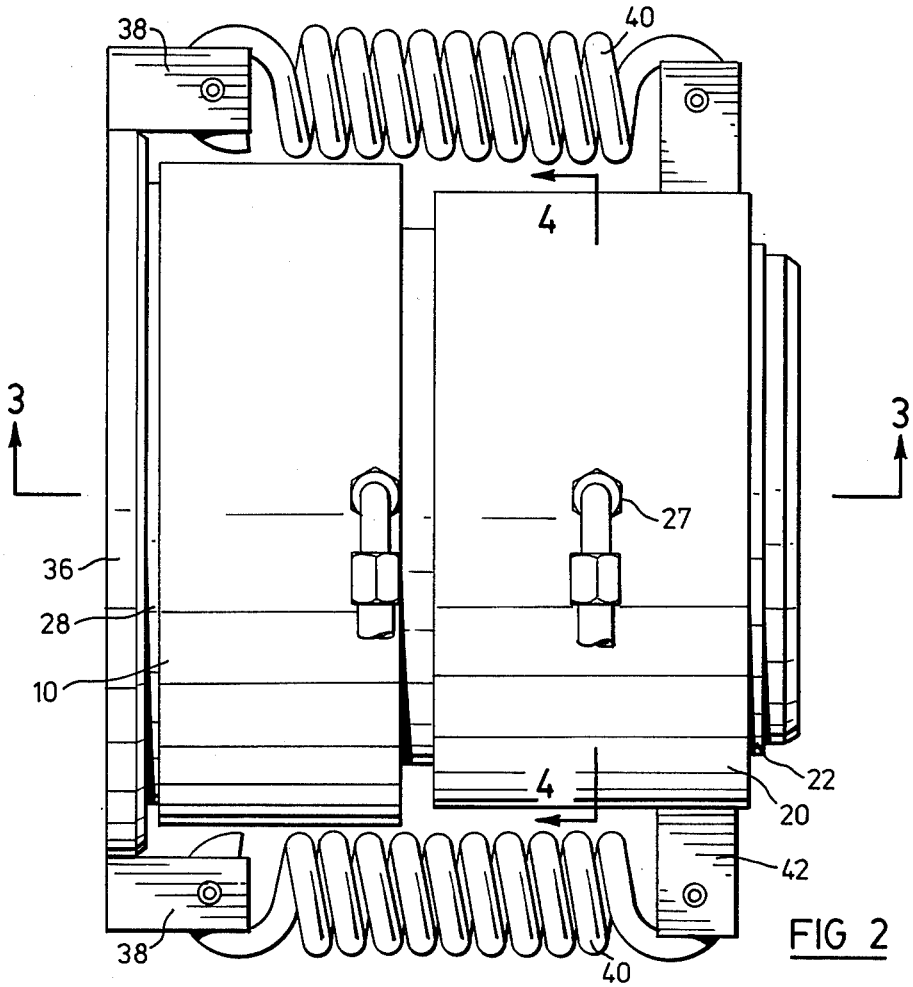
FIG. 2 is a plan view of the device of FIG. 1.

The embodiment of the invention illustrated in the drawings has a body 10 of annular configuration. There are four cylinder chambers 12 in one end of the body that extend radially of the body. Each radially extending cylinder opening has a piston 14 mounted therein. Numerals 16 refer to piston seals.

The inner seals of the cylinder chambers 12 communicate with each other hydraulically through a circumferentially extending channel 18 in the circumferentially extending collar 20. A snap ring 22 holds collar 20 in place and seals 24 ensure hydraulic sealing. An opening 26 in the collar is designed to admit a fitting 27 for the admission of hydraulic fluid to the chambers 12 in use as will be explained later.

A press ram of annular cross section 28 is adapted to move axially of the casing 10 within a press ram chamber formed in the end of the casing. Seals 30 seal the press ram 28 with the walls of its chamber. At the bottom end of the axially extending chamber, an inlet port for hydraulic fluid 34 extends through the casing to the bottom of the ram. In use, hydraulic fluid is admitted to the inlet port 34 and is supplied to the bottom end of the ram 28. A fitting for admitting hydraulic fluid under pressure is secured to the inlet opening 34.

A ring 36 on the free end of the ram 28 has diametrically opposed lugs 38 which connect with springs 40. Springs 40 connect at their opposite ends to lugs 42 which are mounted on the casing 10. Springs 40 are in tension and designed to return the ram 28 to its inward position illustrated in FIG. 3 when the pressure in the ram chamber is released.

A mark (not shown) on the ram 28 that is visible to an operator indicates when the ram has been extended its intended travel. Alternatively, a stop member could be used to limit outer travel of the ram or limiting the amount of hydraulic fluid admitted to the ram chamber could be used to limit travel.

In use, a hydraulic hose capable of delivering a hydraulic fluid under pressure is connected to each of the fittings 26 and 35. The body is slipped over a gear or like shaft so that the shaft extends through the opening in the body. Hydraulic fluid under pressure is, then, supplied through fitting 26 to the header 18 to pressurize the inner ends of the radially extending pistons 14. These pistons are in opposed relation to each other and move inwardly to engage and grip the shaft. In the embodiment of the invention illustrated, pistons 14 have a diameter of about 2 inches and are capable of developing a holding power on the shaft in excess of 60 tons with a hydraulic pressure of about 10,000 pounds per square inch. When the pistons have been actuated against the shaft to grip it the supply line to the header 18 is closed and the device is in firm gripping arrangement on the shaft.

Figure 3:
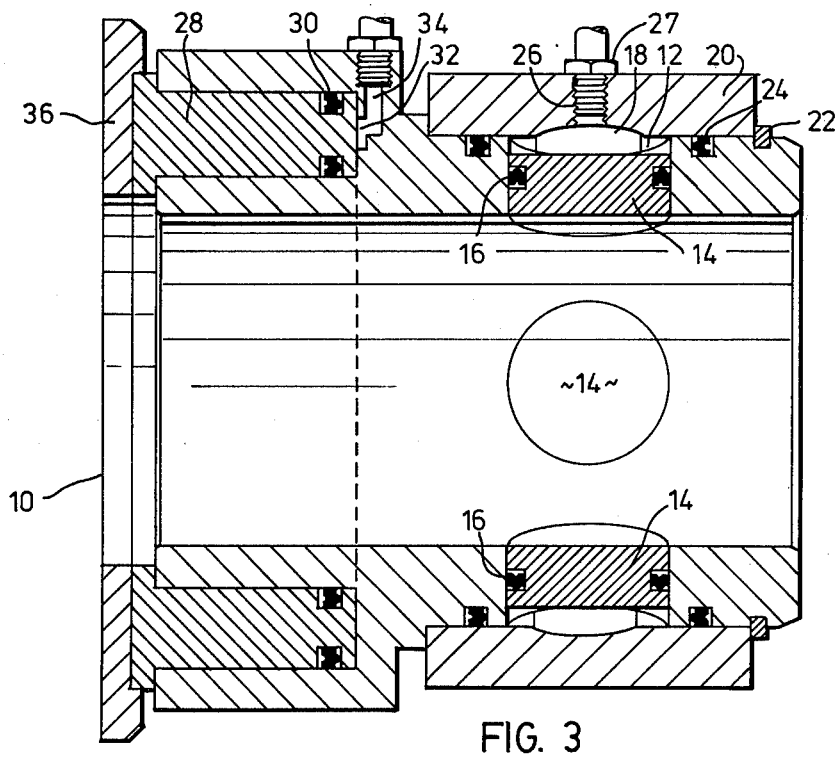
FIG. 3 is a sectional view along the line 3—3 of FIG. 2.
Figure 4:
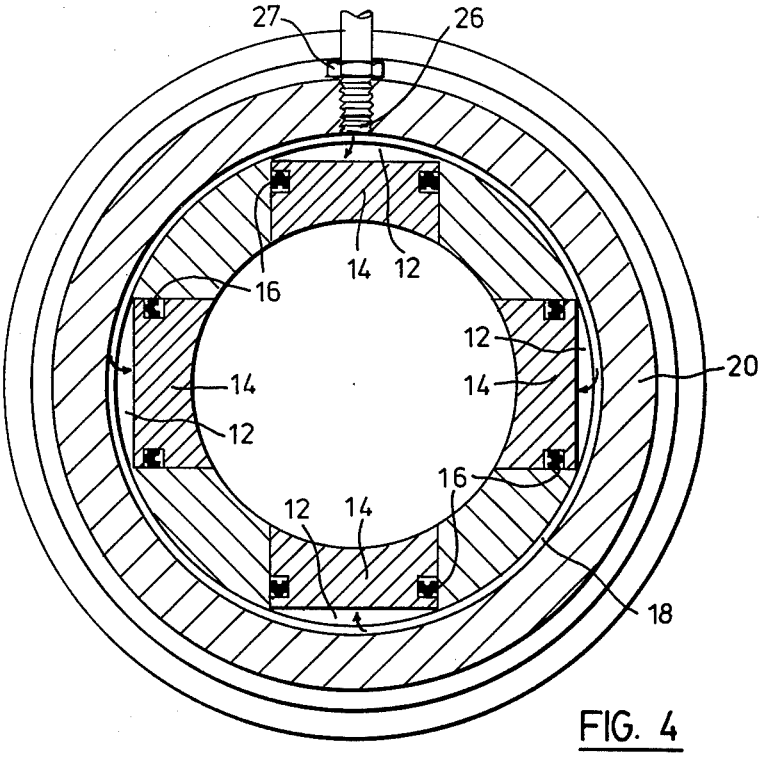
FIG. 4 is a sectional view along the line 4—4 of FIG. 2.

The axially extending press ram 28 is, at this stage, fully retracted under the action of springs 40 and in the position of FIG. 3. The device has been located on the shaft with the annular ring 36 in abutting relation with a gear or the like which is to be moved in a position away from the body of the device in an axial direction. Hydraulic fluid under pressure is, then, supplied through the filling 35 and port opening 34 to the lower end of the press ram 28 to move it outwardly. The pressure developed by fluid supplied to the press ram 28 is exerted against the rear to move it with respect to the shaft and away from the body 10 of the device which is rigid with respect to the shaft. The amount of pressure supplied depends upon the pressure of the hydraulic fluid supplied to the unit and the area of the press ram 28. Sufficient pressure is applied up to the holding force of the radially extending pistons to do the job required. This is a matter of design but with the unit illustrated, there is no difficulty in achieving a press of 60 tons.

It will be apparent that the force applied to the axially extending ram must be within the holding power of the radially extending pistons and that variation can be achieved by either design of piston cross sections or hydraulic pressures applied to the device.

The device is used in accordance with general puller technique. In some cases, the free end of ring 36 is not applied directly against the gear to be removed, but rather the device is applied to the shaft in a direction such that the movement of the press ram 28 is away from the gear to be removed. The gear is connected to the plate 36 by means of puller rods and a puller plate. The design of puller rods and puller plates is very well known and not discussed in this application. Suffice it to say that it is intended that the device be used in accordance with standard practice in respect of puller rods and puller plates.

One feature of the device that is thought to be worthy of special mention is the ease and the flexibility with which the device can be connected onto a shaft. It can be quickly mounted by the application of hydraulic pressure as just indicated and, just as quickly released by releasing the hydraulic pressure. The stroke of the presser ram 28 may be relatively small but the device can be quickly mounted on a shaft, the ram operated to move the gear to the limit of the extent of its travel; the pressure relieved in the axial direction; the device relieved from the shaft by relieving the pressure on the radially extending pistons; the device moved along the shaft an increment substantially equal to the travel of the piston; clamped again to the shaft and; then operated to move the axially extending piston 28 again for its full extent.

By incremental movement in this way, it is possible to achieve a long pull on a gear or the like with speed and ease because the device can be mounted easily in any location with a minimum of effort.

The devices of the prior art where the device had to be secured to a shaft by threading have an inherent limitation in respect of the location of the device due to the location of the threads upon which the device must be mounted.

Figure 5:
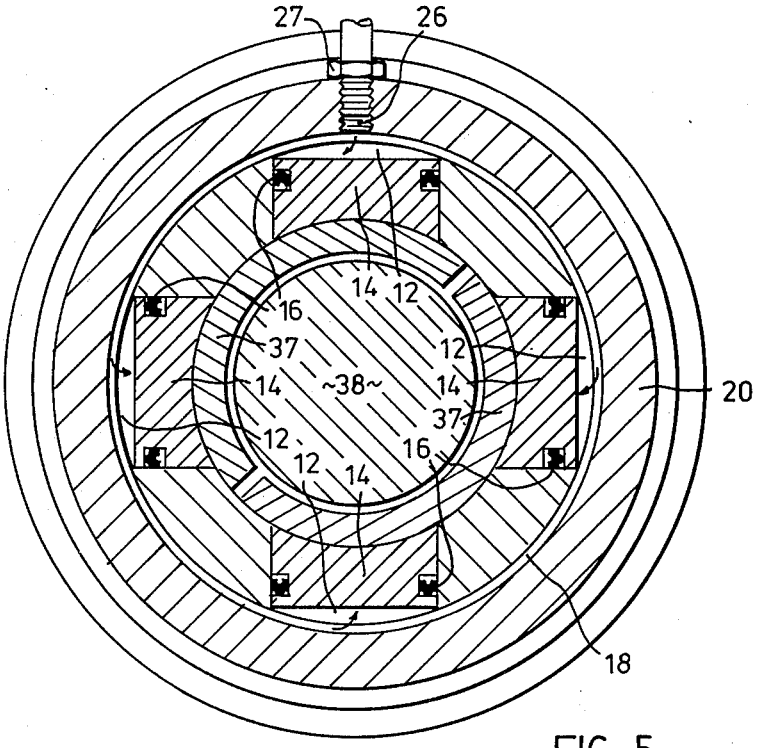
FIG. 5 is a sectional view illustrating the use of adapters for using the device on a smaller shaft.

The device can be adapted for use with different size shafts by using sleeve adapters within the opening of the body 10. The sleeve adapters comprise a pair of split sleeve sections 37 designed to fit inside the bore of body 10 and to loosely embrace a shaft 38 of smaller bore with which it is desired to use the device. In use, the gripping power of piston 18 is transferred to a smaller shaft, as illustrated in FIG. 5.

The embodiments of the invention in which an exclusive property or privilege is claimed are defined as follows:

1. A fluid gear or like pulling device comprising a body having a through axial bore adapted to admit a shaft;

opposed piston chambers extending radially of said bore;

pistons in said piston chambers and having a free end adapted to enter into said through bore;

means for pressurizing said piston chambers with fluid to force said pistons outwardly of their chambers and into said through bore;

a press ram mounted in said body for movement axially thereof;

and means for moving said press ram axially of said body said body being sleeve shaped, said piston chambers extending through said sleeve shaped body from outside to inside, the outer end of said chambers being formed by the inner side of a ring that extends around the outside of said body.

2. A fluid gear or like pulling device as claimed in claim 1 in which the fluid is a hydraulic fluid.

* * * * *